US006565484B1

(12) United States Patent
Reinhardt

(10) Patent No.: US 6,565,484 B1
(45) Date of Patent: May 20, 2003

(54) FENCING SWORD

(75) Inventor: Julius Henry Reinhardt, Oxford, GA (US)

(73) Assignee: William C. Adams, Roberta, GA (US)

( * ) Notice: Subject to any disclaimer, the term of this patent is extended or adjusted under 35 U.S.C. 154(b) by 0 days.

(21) Appl. No.: 10/057,653

(22) Filed: Jan. 23, 2002

(51) Int. Cl.[7] ..... A63B 69/02
(52) U.S. Cl. ..... 482/12; 446/473
(58) Field of Search ..... 482/12, 148, 83; 446/47.1, 486, 473; 30/346, 356, 165, 318, 235, 248, 257; D21/725, 568, 567; 29/34 R; D22/118; D08/20, 93, 94, 97, 102, DIG. 5; 463/47.1, 47.2, 47.4

(56) References Cited

U.S. PATENT DOCUMENTS 308,703 A * 12/1884 Richardson ..... 30/519
488,667 A * 12/1892 Stewart ..... 30/309
2,803,087 A 8/1957 Zalkind
2,868,542 A 1/1959 Mieg
2,998,974 A 9/1961 Stafford
D222,938 S * 2/1972 Cole ..... D22/118
D247,716 S * 4/1978 Koob ..... D7/649
4,817,942 A 4/1989 Begon
5,322,277 A 6/1994 Paul et al.
D353,971 S * 1/1995 Inoue ..... D7/416

* cited by examiner

*Primary Examiner*—Stephen R. Crow
(74) *Attorney, Agent, or Firm*—Rodgers & Rodgers

(57) ABSTRACT

A fencing sword comprising a planar sword blade with a handle fixed to one end of the blade and a safety tip affixed to the other end, the blade having proximate and distal ends, and the distal end of the blade disposed angularly disposed with respect to the proximate end of the blade.

3 Claims, 1 Drawing Sheet

FENCING SWORD

BACKGROUND OF THE INVENTION

Over the years, the sport of fencing has enjoyed increased popularity with adults as well as children. Normally, fencing participants are closely supervised and coached so as to minimize the risk of injury. When fencing swords are used without proper supervision, especially with children, the possibility of injury is greatly increased. One typical type of injury is when an opponent is cut by means of the sword blade due to bodily impact with the sharp edge of the blade.

BRIEF SUMMARY OF THE INVENTION

By this invention, a fencing sword comprises distal and proximate ends with a sword handle disposed at the proximate end and with the portion of the blade disposed toward the distal end positioned at an angle with respect to the portion of the blade extending toward the proximate end.

DETAILED DESCRIPTION OF THE INVENTION

Figure 1:
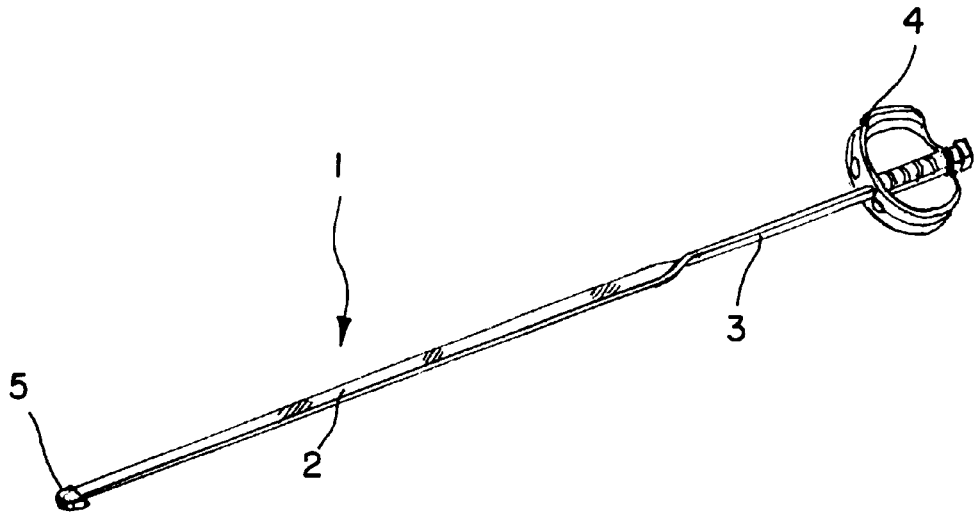
FIG. 1 is a perspective view of a fencing sword according to this invention.

In the drawings and with particular reference to FIG. 1, a fencing sword according to this invention is shown wherein the numeral 1 generally designates the fencing sword blade having distal portion 2 and proximate portion 3. Conventional sword handle 4 is attached to fencing blade 1 at the proximate end thereof. Additionally, conventional protective tip 5 is fixed onto the distal end of the fencing sword blade 1.

Figure 2:
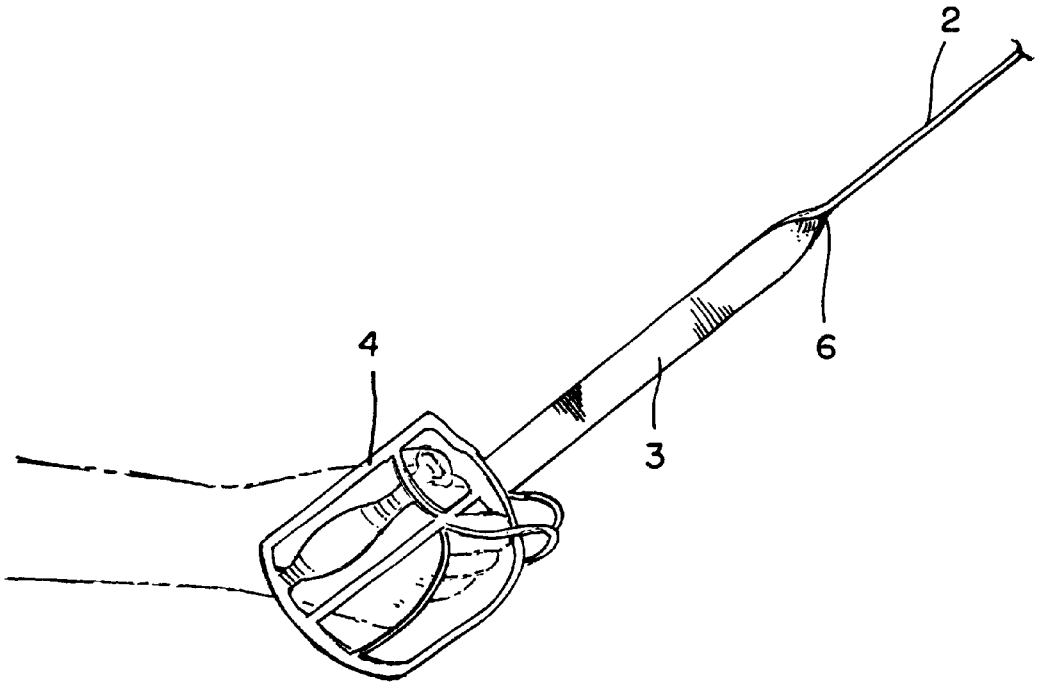
FIG. 2 is an enlarged perspective of the fencing sword shown in FIG. 1.

As best viewed in FIG. 2, between the proximate and distal ends of sword blade 1, sword blade 1 is twisted at the point on sword blade 1 identified by the numeral 6. Therefore, by means of twist 6 the distal end of sword blade 1 is disposed at a 90 degree angle with respect to the proximate end thereof.

By this invention, fencing sword 1 is provided which is much safer than conventional fencing swords whereby the portion of the sword blade which would typically come in contact with an opponent's body is disposed such that the flat planar surface of the blade extending toward the distal end will strike the body rather than the sharp edge of the blade. By this means, safety is enhanced and, at the same time, the integrity of the fencing competition is maintained.

What is claimed is:

1. A fencing sword comprising a blade, said blade having distal and proximate ends, said blade being of a generally elongated planar configuration, a handle fixed at the proximate end of said blade, and the portion of said blade extending toward said distal end being disposed at a ninety degree angle with respect to the portion of said blade extending toward said proximate end; wherein said blade portions remain in a generally linear alignment.

2. A fencing sword according to claim 1 wherein the angularly disposition of said proximate and distal end is achieved by means of a twist in said blade.

3. A fencing sword according to claim 1 wherein a safety tip is fixed to said distal end.

* * * * *